US005282419A

United States Patent [19]

Barrois

[11] Patent Number: 5,282,419

[45] Date of Patent: Feb. 1, 1994

[54] INK ROLLER

[75] Inventor: Claus D. Barrois, Erlenbach, Fed. Rep. of Germany

[73] Assignee: Koenig & Bauer Aktiengesellschaft, Wurzburg, Fed. Rep. of Germany

[21] Appl. No.: 22,531

[22] Filed: Feb. 25, 1993

[30] Foreign Application Priority Data

Feb. 29, 1992 [DE] Fed. Rep. of Germany ..... 4206403
Dec. 17, 1992 [DE] Fed. Rep. of Germany ..... 4242605

[51] Int. Cl.[5] ..... B41F 31/02

[52] U.S. Cl. ..... 101/367; 101/350; 101/364; 101/331

[58] Field of Search ..... 101/147, 148, 331, 350, 101/363, 365, 367, 364; 492/16, 18, 30–37, 49; 401/151, 197, 220

[56] References Cited

U.S. PATENT DOCUMENTS

| | | | |
|---|---|---|---|
| 916,357 | 3/1909 | McCarty | 101/367 |
| 1,180,569 | 4/1916 | Chisholm | 101/367 |
| 2,217,552 | 10/1940 | Horton | 101/367 |
| 2,319,615 | 5/1943 | Luehrs | 101/367 |
| 2,961,948 | 11/1960 | Quinn | 101/148 |

FOREIGN PATENT DOCUMENTS

| | | |
|---|---|---|
| 600924 | 7/1934 | Fed. Rep. of Germany . |
| 1044830 | 12/1952 | Fed. Rep. of Germany . |
| 1952097 | 10/1969 | Fed. Rep. of Germany . |
| 232141 | 3/1973 | Fed. Rep. of Germany . |
| 8400516 | 8/1983 | PCT Int'l Appl. . |
| 464458 | 6/1975 | U.S.S.R. . |

*Primary Examiner*—Edgar S. Burr
*Assistant Examiner*—Ren Yan
*Attorney, Agent, or Firm*—Jones, Tullar & Cooper

[57] ABSTRACT

An ink roller for a rotary printing press has a hollow axle that receives ink from a pressurized ink supply. The axle is provided with a plurality of radial bores that are selectively aligned with similar radial in concentrically arranged inner and intermediate sleeves. A porous outer sleeve is concentric with the intermediate sleeve. The inner sleeve oscillates on the axle while the intermediate sleeve and the outer sleeve both rotate at different speeds to provide the outer sleeve with a positive rotational speed differential.

13 Claims, 4 Drawing Sheets

INK ROLLER

FIELD OF THE INVENTION

The present invention is directed generally to an ink roller. More particularly, the present invention is directed to an ink roller for a rotary press. Most specifically, the present invention is directed to a method and apparatus for supplying ink to an ink roller for a rotary press. An ink roller has a central hollow shaft that carries inner and intermediate sleeves. This shaft and these sleeves have radially extending axial bores through which ink that is supplied to the hollow central shaft can pass. An outer porous shell or sleeve is supported for rotation on the intermediate sleeve. The ink that is supplied to the central shaft is metered as it passes through the bores in the inner and intermediate sleeves. The outer porous sleeve is rotated at a speed different from that of the rotating intermediate sleeve thereby creating a pressure differential in the ink at the outer surface of the intermediate sleeve.

DESCRIPTION OF THE PRIOR ART

Inking rollers for use with rotary printing presses are generally known in the art. These inking rollers are used to apply ink to an ink forme cylinder which then applies ink to the printing plates on a plate or forme cylinder. Alternatively, the ink roller may be used to apply the ink directly to the forme cylinder. One prior art ink roller is shown in U.S. Pat. No. 916,357. In this patent there is disclosed a rotary ink roller which is usable with printing presses and in which the ink is supplied to the exterior of the roller from an internal reservoir through passages in two hollow concentric cylinder-shaped bodies. These two concentric hollow cylinders each have a plurality of radially extending bores or passages that allow ink to pass from the central reservoir out to an ink permeable shell. The two hollow concentric cylinder shaped bodies are adjustable with respect to each other. A hollow cylinder is supported for free rotation in the central ink reservoir. As this ink roller rotates the freely rotatable hollow cylinder in the reservoir acts to press the ink out through the bores in the two hollow cylinder and through the porous outer shell.

This prior art device has to be brought to a standstill before the interior reservoir can be refilled with ink. This means that the printing process must be stopped while the ink reservoir is being refilled. Any such printing process interruptions clearly have a negative effect on production quantity and are also apt to reduce production quality. The abutment of the freely rotatable inner cylinder in the interior of the ink reservoir causes an uneven ink wetting of the ink permeable outer shell of this prior art ink roller. Such an uneven wetting also reduces the quality of the printed product since the forme cylinder will be unevenly coated with ink from the ink roller.

Another limitation of this prior art device is the out-of-balance effect that is caused by the freely rotatable cylinder which is eccentrically carried in the central ink reservoir. If the ink roller of this prior art device is caused to rotate at relatively high rotational speeds, this out-of-balance will result in a printed product that has poor printing quality.

It will thus be apparent that a need exists for an ink roller and for a method of operating such an ink roller which will overcome the limitations of the prior art.

The ink roller of the present invention provides such a device and its method of operation and is thus a significant improvement over the prior art devices.

SUMMARY OF THE INVENTION

It is an object of the present invention to provide an ink roller.

Another object of the present invention is to provide an ink roller for a rotary press.

A further object of the present invention is to provide a method and apparatus for supplying ink to the outer surface of an ink roller.

Yet another object of the present invention is to provide a hollow, rotatable ink roller having a plurality of relatively rotatable cylindrical sleeves.

Still a further object of the present invention is to provide an ink permeable ink roller having an adjustable ink permeability.

Even yet another object of the present invention is to provide an ink roller and a method of its operation which generates a pressure differential across the porous outer sleeve.

As will be discussed in greater detail in the description of the preferred embodiment which is set forth subsequently, the ink roller of the present invention utilizes a central hollow shaft to support an inner sleeve and an intermediate sleeve, both of which are provided with a plurality of alignable, radially extending bores which are, in turn, selectively alignable with a plurality of bores in the hollow shaft. The inner and intermediate sleeves are each rotatably supported on the hollow shaft and can be shifted to vary the flow capacity of the ink supplied to the outer periphery of the intermediate sleeve. An ink permeable outer sleeve or shell is supported for rotation on the intermediate sleeve. The outer peripheral surface of the intermediate sleeve is provided with a plurality of recesses or bottoms and separating lands or plateaus. As the outer porous sleeve or shell is caused to rotate relative to the intermediate sleeve, this array of recesses and plateaus creates a pressure differential in the spaces between the outer peripheral surface of the intermediate sleeve and the inner surface of the outer shell. This pressure differential results in the even, thorough distribution of the ink on the outer surface of the porous outer sleeve of the ink roller.

The ink roller of the present invention facilitates the concise metering of ink to the periphery of the roller. The distribution of ink from the roller interior through the inner and intermediate sleeves to the porous exterior sleeve can be precisely metered during operation of the ink roller and in accordance with production requirements. This is accomplished by proper control of the relative speeds of rotation and shifting between the inner shaft, the inner and intermediate sleeves and the outer porous sleeve.

The use of the ink roller of the present invention provides several advantages over the prior art devices. The arrangement of the inner and intermediate sleeves on each other and the functioning of the ink roller according to the invention on its whole, allows the print ink to be metered in accordance with the respective production conditions. This is effected by regulating the permeability of the roller in the radial direction by the positioning of the bores in relation to each other. In this connection, the bores extending from the hollow axle in the radial direction, are initially charged with the same ink pressure, independent from the position of the ink supply. The flow of the ink between the hollow axle and the first sleeve can be opened or closed, to generate the ink pressure. This opening and closing is accomplished by oscillating the inner sleeve with respect to the hollow shaft at a desired frequency. By generating a constant, but different rotational speed between the second intermediate sleeve and the peripheral porous sleeve, there is created, due to the pressure and suction effect of the polygonal profile of the outer surface of the second sleeve on the porous third peripheral sleeve, a pulsating suction and pressure effect which leads to an even, homogeneous ink film on the surface of the ink roller. In this connection, this ink film is meterable in its thickness in consequence of the adjustable permeability of the hollow axle with respect to the first inner sleeve. In addition, there is a balance between the supplied and taken away or flown-off ink quantities.

The ink roller of the present invention does not need to be cleaned. Instead, it is intended that, after the ink roller has been used to print a particular color, it will be removed from the printing machine and will be stored in a foil envelope or the like. When the same color is to again be used, the ink roller can again be put into the printing machine. This is a particularly advantageous procedure, especially when using custom colors.

The ink roller in accordance with the present invention and its method of use is far superior to the prior art devices. It represents a substantial advance in the art.

BRIEF DESCRIPTION OF THE DRAWINGS

While the novel features of the ink roller and its method of use in accordance with the present invention are set forth with particularity in the appended claims, a full and complete understanding of the invention may be had by referring to the detailed description of the preferred embodiment which is set forth subsequently, and as illustrated in the accompanying drawings, in which:

DESCRIPTION OF THE PREFERRED EMBODIMENT

Figure 1:
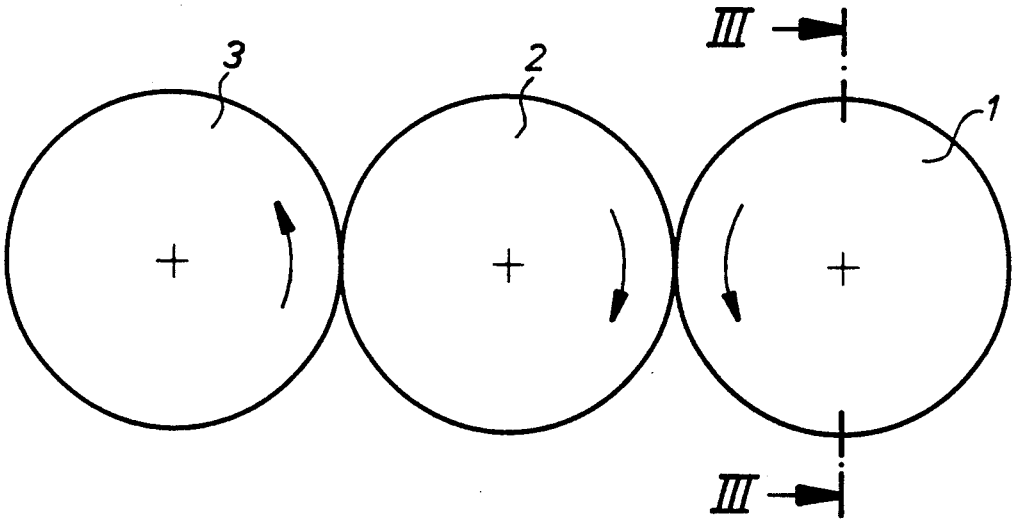
FIG. 1 is a schematic side elevation view of an arrangement of an ink roller in accordance with the present invention in a printing unit.

Referring initially to FIG. 1, there may be seen a schematic depiction of a portion of a rotary printing press in which there is provided an ink roller, generally at 1, in accordance with the present invention. Ink roller 1 is supported for rotation, as will be discussed shortly, and is positioned adjacent, and in contact with an ink forme roller 2. The ink forme roller 2 is, in turn, in contact with a forme cylinder 3. It will be understood that ink is supplied by the ink roller 1 to the ink forme roller 2 and then to suitable printing plates on the surface of the plate or forme cylinder 3.

Figure 2:
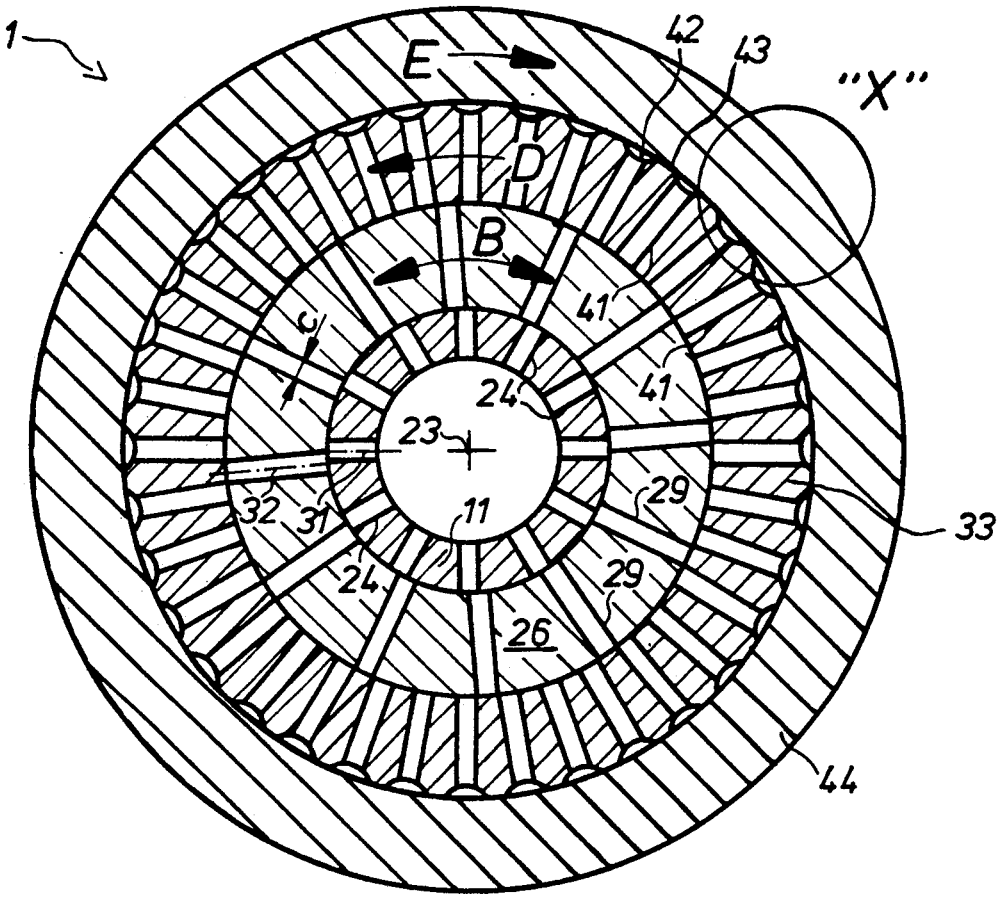
FIG. 2 is a cross-sectional view of an ink roller and taken along the line II—II of FIG. 3.
Figure 3:
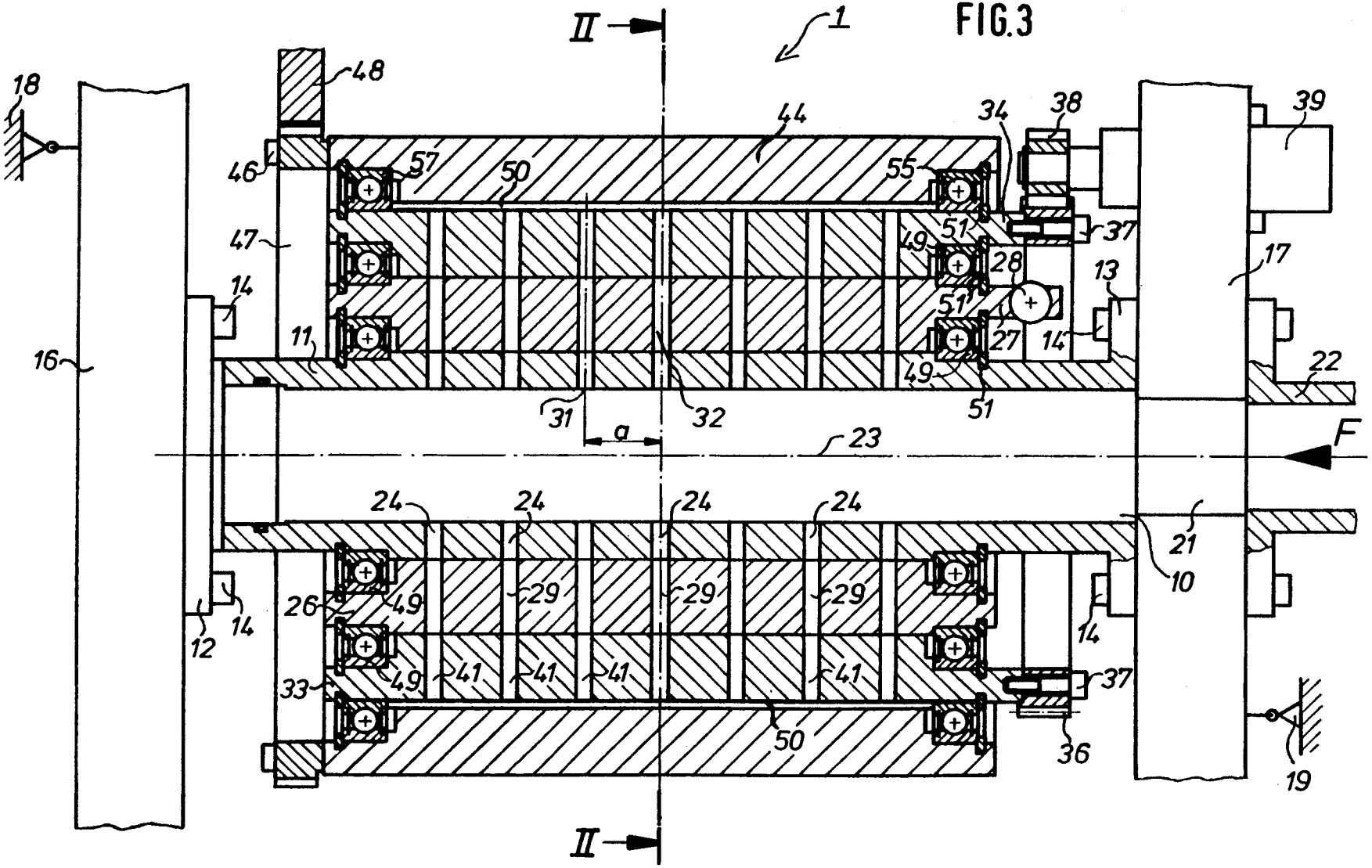
FIG. 3 is a side elevation view partly in section of the ink roller and its supports and taken along line III—III of FIG. 1.

Turning now to FIGS. 2 and 3, the ink roller 1 in accordance with the present invention has a hollow axle 11 with an interior ink reservoir 10. Axle 10 is attached by means of ring flanges 12 and 13, and screws 14 to side members or frame 16 and 17. The frame 16 and 17 is attached to the machine frame 18 and 19. The hollow axle 11 and its ink reservoir 10 is connected with an ink supply 22 by a bore 21 in the frame 17. Ink supply 22 is connected to a not represented ink reservoir which can be pressurized by a suitable pressure medium. The hollow axle 11 has, at its circumference, a plurality of bores 24 which are arranged in axially spaced groups or rings. The bores 24 in each ring of bores, when looked at from an axially extending center line 23 of the ink roller 1, extend in the radial direction of the roller 1 and are in alignment with each other about the axle's circumference. Each of these "rings" of bores 24 is formed, respectively, at an axial spacing "a" to each other.

On this hollow axle 11, there is concentrically positioned a first, inner sleeve 26 that has an axially extending butt strap 27 on its first end. An actuating cylinder 28 is hinged to the frame 17 and is secured to strap 27. The actuating cylinder 28 can be executed as a pneumatic cylinder and can be in connection with a known, regulating device which is not specifically shown in the drawings. This first, inner sleeve 26 is rotatably supported on the fixed hollow inner shaft 11 by a plurality of spaced ball bearings 29 and lock rings 51 which will be discussed in detail subsequently. The actuating cylinder 28 is operable to cause the inner sleeve 26 to oscillate or to move back and forth in a circumferential manner on the hollow shaft 11 in the direction indicated by the arrow B in FIG. 2. Since the actuating cylinder 28 is secured to the butt strap 27 on the inner sleeve 25 and to the frame 17, the inner sleeve does not rotate fully on the fixed hollow axle 11 but does oscillate. It also does not move axially along the hollow axle 11.

The first inner sleeve 26 has a plurality of rings of circumferentially spaced, radially extending bores 29, as seen in FIGS. 2 and 3. These bores 29 extend from an inner peripheral surface of the inner sleeve 26 to an outer surface of sleeve 26 and are generally perpendicular to the axial center line 23 of the ink roller 1. The spacing "a" between each ring of bores 29 is, as may be seen in FIG. 3, the same as the spacing "a" between each ring of bores 24 in the hollow axle 11. In addition, the diameter and number of bores 29 in each ring on inner sleeve 26 is the same as the diameter and number of bores 24 on each ring in axle 11.

As was discussed above, the actuating cylinder 28 is secured to the butt strap 27 on inner sleeve 26 and to the frame member 17. When the cylinder 28 is actuated by a suitable control assembly that is not shown in the drawings, it will cause the inner sleeve 26 to oscillate on the hollow axle 11 as indicated by arrow B in FIG. 2. This oscillation B is through an angle of rotation that can have a maximum distance "c" as shown in FIG. 2. This distance "c" corresponds to the diameter of one of the bores 24 in axle 11 or 29 in inner sleeve 26 since these diameters are the same. The frequency of oscillation can be varied but the magnitude of the oscillation is limited to the distance "c". The use of this distance "c" and the orientation of the inner sleeve 26 on the hollow axle 11 is selected so that the bores 24 and 29 can go from a completely aligned configuration at one end of length "c" to a completely disaligned configuration at the second end of length "c". Thus when the actuating cylinder 28 brings the inner sleeve 26 to one end of its oscillating travel, the axial centerlines of the bores 24 in the hollow axle 11 will be aligned with the axial centerlines 32 of the bores 29 in the inner sleeve 26 so that the axle 11 and the inner sleeve 26 are one hundred percent permeable with respect to each other. At the other end of the oscillation distance "c" of the inner sleeve 26, the bores 24 of the hollow axle 11 are offset from the bores 29 of the inner sleeve 26 by the distance "c" which is the same as the diameter of the bores 24 and 29. This means that the bores 24 and 29 and thus the inner sleeve 26 and the hollow axle 11 are one hundred percent impermeable to each other. In the orientations depicted in FIG. 2, the bores 24 and 29 are midway between the end points of their relative travel direction "c". This means that they have a fifty percent permeability with respect to each other.

A second, intermediate sleeve 33 is supported concentrically about the inner sleeve 26, as may also be seen in FIGS. 2 and 3. This intermediate sleeve 33 carries a ring flange 34 on a first end face, as seen in FIG. 3. This flange 34 supports a gear ring 36 by means of screws 37. The gears on the gear ring 36 are in engagement with a drive gear 38 that is driven by a drive motor 39 which is secured to the frame 17. The drive motor 39 is controlled through a suitable connection to a central or adjusting device which is not specifically shown in the drawings. Suitable ball bearings, generally at 49 and suitable locking rings 51 are used to rotatably support the intermediate sleeve 33 on the outer circumferential surface of the inner sleeve 26. The intermediate sleeve 33 is free to rotate about the inner sleeve 26 at a speed dictated by the speed of the drive motor 39 and in the direction D as shown in FIG. 2.

The second, intermediate sleeve 33 is provided with a plurality of axially spaced rings of circumferentially arranged bores 41 with the number of rings of bores 41 and their axial spacing "a" being the same as the bores 24 and 29 on the axle 11 and the inner sleeve 26, respectively. These bores 41, as do bores 24 and 29, extend radially outwardly generally perpendicularly to the axial center line 23 of the ink roller 1. The number of bores 41 in each ring of bores on the intermediate sleeve 33 can be at least as many as, and typically greater than the numbers of bores 23 and 29 in the axle 11 and inner ring 26, respectively. The diameter of each of these bores 41 is, in the preferred embodiment, the same as the diameter of the bores 23 and 29. However, in the preferred embodiment there ar provided three times as many bores 41 on intermediate sleeve 33 as there are bores 23 or 29 in axle 11 or inner sleeve 26, respectively.

Figure 4:
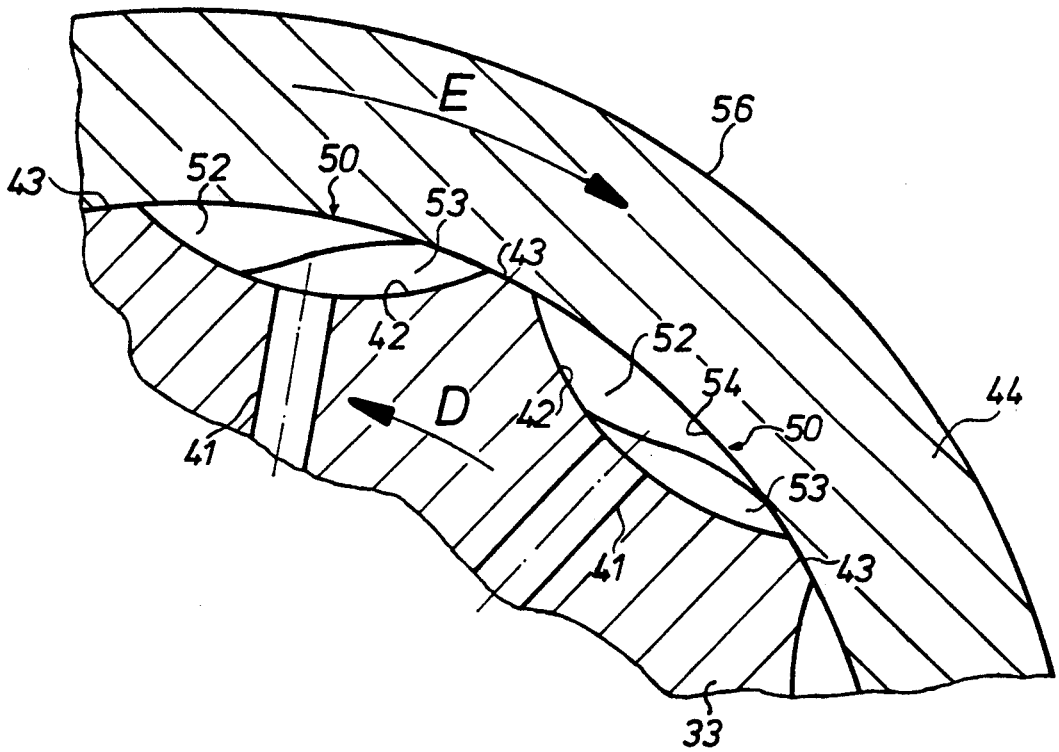
FIG. 4 is an enlarged cross-sectional view of the encircled portion of the ink roller indicated at "X" in FIG. 2.

As may be seen generally in FIG. 2, and in detail in the enlarged portion of FIG. 2 which is shown at FIG. 4, the bores 41 in the intermediate sleeve 33 extend from an inner, generally cylindrical periphery to an outer generally ribbed or ridged peripheral surface of intermediate sleeve 33. Each of the radially extending bores 41 terminates at its radial outer end in intermediate sleeve 33 in a bottom portion 42 of a generally axially extending groove or channel in the outer peripheral surface of intermediate sleeve 33. The plurality of grooves in the outer surface of sleeve 33 are separated by axially extending plateaus or lands 43, as shown most clearly in FIG. 4. These grooves and plateaus or lands 43 serve to give the intermediate sleeve 33 an outer peripheral surface that has an even polygonal profile.

An outer porous sleeve or shell, generally at 44 is supported concentrically about the intermediate sleeve 33 for rotational movement with respect to the intermediate sleeve 33 by suitable ball bearings 55 and 57 which are held in place at the axial ends of the outer shell 44 by suitable lock rings 51, as may be seen most clearly in FIG. 3. A ring gear generally at 47 is secured to an end face of outer sleeve 44 generally at the opposite end of ink roller 1 from the gear ring 36 that is secured to the end face of intermediate sleeve 33, as may also be seen in FIG. 3. This ring gear 47 is in gear mesh engagement with a drive gear 48 that is driven by the printing machine. The ring gear 47 can be attached to the end face of the outer sleeve 44 by suitable means, such as screws 46. Alternatively, the ring gear 47 can be glued or welded to the end face of the outer porous sleeve 44.

The material used for the hollow axle 11, the inner sleeve 26 and the intermediate sleeve 33 is preferably steel. However, the first on inner sleeve 26 could also be made of a material, such as brass, that would provide emergency running properties in case of a failure of one of the bearing assemblies at the ends of the inner sleeve 26 or the intermediate sleeve 33. The outer porous sleeve 44 is preferably made of a porous ceramic or plastic material. If the outer sleeve 44 is made of a porous, compressible plastic material, the ink forme roller 2 can be omitted and the resilient outer surface of the porous plastic outer sleeve 44 can be brought into direct contact with the surface of the plates on the plate or forme cylinder 3.

In operation of the ink roller 1 in accordance with the present invention, ink is supplied under a suitable pressure from the pressurized ink reservoir or ink supply, which is not specifically shown, through the ink supply line 22 and the bore 21 to the ink reservoir 10 in the hollow axle 11. The ink flows in the direction indicated by arrow F in FIG. 3. As the ink flows into the hollow axle 11, it also flows radially outwardly into the bores 21 in the hollow axle 11 in a direction that extends radially outwardly from the center line 23 of the ink roller toward the inner peripheral surface of the first, inner sleeve 26. As was discussed previously, depending on the stroke length of the actuating cylinder 28 for the inner sleeve 26 and thus the magnitude "c" of the angle of rotation of the inner sleeve 26 with respect to the fixed hollow axle 11, the permeability of the bores 24 with respect to the bores 29 in the inner sleeve 26 will be determined. This permeability; i.e. the effection stroke length "c" caused by the actuating cylinder 28 can be adjusted in accordance with production requirements. The control of the actuating cylinder 28 with respect to both its frequency and amplitude of movement can be controlled by a suitable computer in the machine control stand of the printing machine.

As the inner sleeve 25 is caused to oscillate on the hollow axle 11 in the direction B through the length "c" or the like, the permeability of the inner sleeve with respect to the hollow axle 11 can range between, for example fifty percent and zero percent. When the permeability is zero, there will be a build-up of new ink pressure in the ink reservoir 10 and in the bores 24 of the hollow axle. The stroke frequency of the actuating cylinder 28 is adjustable by the not depicted stroke control and regulating device. In the preferred embodiment, the stroke frequency of the actuating cylinder 28 can be three cycles per second. It will be understood that there is an inversely proportional relationship between stroke length and frequency. The longer the stroke length the smaller the frequency or the shorter the stroke length, the longer the frequency for obtaining the same ink flow rate.

As the bores 29 in the inner sleeve 26 are aligned with the bores 24 in the hollow axle ink will flow to the outer periphery of the inner sleeve 26 and will pass into the radially extending bores 41 in the intermediate sleeve 33. Since this intermediate sleeve 33 is rotating at a generally constant speed in the direction indicated by arrow D in FIG. 2, each bore 41 in intermediate sleeve 33 will pass over a bore 29 in the inner sleeve 26. Since there are substantially more bores 41 in each ring of bores in intermediate sleeve 33 than there are bores 29 in inner sleeve 26 there will be provided a fine dispersion of ink through the bores 41 in the intermediate sleeve 33 to the outer surface of the intermediate sleeve 33.

Referring again to FIGS. 2 and 4, it will be seen that the porous outer sleeve 44 is preferably driven in a direction of rotation, as indicated by arrow E, which is opposite to the direction of rotation of intermediate sleeve 33. Alternatively, the two sleeves 33 and 44 can be driven in the same rotational direction but at different rotational speeds so that there is created a relative speed difference or slippage between the intermediate sleeve 33 and the outer porous sleeve 44.

As may be seen most clearly in FIG. 4, there are a plurality of generally axially extending chambers 50 on the outer surface of the intermediate sleeve 33. These chambers are formed between the chamber bottoms 42 of the bores 41 and the adjacent axially extending plateaus or lands 49 and are further defined by an inner side or inner peripheral surface 54 of the outer porous sleeve 44. Because of the relative rotational movement of the intermediate sleeve 33 and the outer sleeve 44 in the direction indicated by arrows D and E, respectively in FIGS. 2 and 4, there is formed in the left half 52 of each chamber 50 a negative pressure or suction effect, and, in the right half 53 of each chamber 50 an overpressure. This creates on an outer surface 56 of the outer porous shell 44 an overpressure which generates a pulsation and effects an even wetting of the outer surface 56 of the outer porous shell 44. This causes the formation of an ink film on the outer surface 56 of the outer porous shell 44, which is the outer surface of the ink roller 1 which is adaptable to production conditions and which can be accurately metered and controlled. This ink film is then transferred, either by ink forme roller 2 to forme cylinder 3 or directly from ink roller 1 to forme cylinder 3.

As was discussed previously, the relative rotation between the intermediate sleeve 33 and the porous outer sleeve 44 can be accomplished in either of two ways. Either the rotational directions of the two can be opposite to each other or they can be in the same direction but at different speeds. It is however desirable that the difference in speed between the two be maintained generally constant. It is preferable that this rotational difference be in the range of 2,500 to 3,500 revolutions per hour. If, for example, the ink roller 1 is to have a rotational speed of 3,000 revolutions per hour, the outer sleeve 44 may be driven at this speed by gear 18 in the direction E, as seen in FIGS. 2 and 4. The intermediate sleeve 33 may be driven by its drive motor 39 at a speed of 500 revolutions per hour in the opposite direction, as indicated by arrow D in FIG. 2. The resultant speed difference between the intermediate sleeve 33 and the outer sleeve 44 is 3,500 revolutions per hour. Since the outer sleeve 44 has a higher speed than the intermediate sleeve 33 it will have a positive difference speed.

In the production situation where the rotational speed of the ink roller is to be increased above the optimal differential speed, for example to a rotational speed of outer sleeve of 6,000 revolutions per hour, it is then necessary to drive the intermediate sleeve 33 in the same rotational direction, but at a lower rotational speed to maintain the rotational speed differential between the two in the preferred 2,500 to 3,500 revolutions per hour range. In this situation, the intermediate sleeve 33 is driven in the same direction as the outer sleeve 44 but at a rotational speed of 3,500 per hour. This results in a positive speed difference of 2,500 revolutions per hour of the outer sleeve 44 with respect to the intermediate sleeve 33. In the situation, the direction of rotation D of the intermediate sleeve 33 is the same as the direction of rotation E of the outer sleeve 44.

The printing ink which is supplied to the concentrically arranged sleeves is prevented from leaking out at the axial ends of the sleeves by the bearing assemblies 49, 55, and 57 since these assemblies are provided on both sides with suitable sealing ducts. These bearings are also supported in suitable bearing channels in the concentric sleeves, as seen in FIG. 3. This insures that the ink that enters ink reservoir 10 will all flow through the various bores 24, 29, and 41 and will eventually arrive in the chambers 50 on the outer surface of the intermediate sleeve 33 for passage through the porous outer sleeve 44 to its outer surface 56.

As may be seen most clearly in FIG. 4, the chambers 50 in the outer peripheral surface of the intermediate sleeve 33 are generally lenticular in cross-section and are divided into the left, low pressure or negative pressure chamber half 52 and the right or high pressure chamber half 53, assuming the direction of rotation shown in FIG. 4. As discussed previously, this pressure gradient causes the ink supplied through the bores 41 to be absorbed through the inner surface 54 of the outer porous sleeve 44. These chambers 50 may extend axially along the outer surface of the intermediate sleeve 33 and are limited at their ends by the inner races and sealing disks of the ball bearing assemblies 55 and 57 which are arranged between the outer periphery of the intermediate sleeve 33 and the inner surface 54 of the outer porous sleeve 44. It is also possible to provide the axially extending chambers 50 with a slight circumferential twist. The alternating arrangement of chambers 50 and separating plateaus or lands 49 provides the outer circumference of the intermediate sleeve 44 with a polygonal cross-section; i.e. with an outer cross-sectional surface that has a polygonal array.

While a preferred embodiment of an ink roller for a rotary press and its method of operation in accordance with the present invention has been set forth fully and completely hereinabove, it will be apparent to one of skill in the art that a number of changes in, for example, the overall size and length of the roller, the number of rings of bores, the specific structure of the bearings and the like could be made without departing from the true spirit and scope of the present invention which is accordingly to be limited only by the following claims.

What is claimed is:

1. An ink roller usable to supply printing ink to a forme cylinder in a rotary printing press, said ink roller comprising:

a hollow axle having an ink receiving reservoir and a plurality of radially extending, circumferentially arranged first bores;

means for supplying printing ink to said ink receiving reservoir;

an inner sleeve supported for rotation on said hollow axle and having a plurality of radially extending, circumferentially arranged second ink bores, said second ink bores being selectively alignable with said first ink bores;

an intermediate sleeve rotatably supported on said inner sleeve and having a plurality of radially extending, circumferentially arranged third ink bores, said third ink bores being selectively alignable with said second ink bores;

a porous outer sleeve rotatably supported on said intermediate sleeve;

means for oscillating said inner sleeve on said hollow axle to relatively align said first bores and said second bores;

means to rotate said intermediate sleeve in a first direction and at a first rotational speed; and means to rotate said outer sleeve in a second direction and at a second rotational speed, said first and second rotational speeds and directions being selected to provide said outer sleeve with a positive rotational speed differential with respect to said intermediate sleeve.

2. The ink roller of claim wherein said means for oscillating said inner sleeve includes an actuating cylinder.

3. The ink roller of claim 2 wherein said actuatory cylinder is operable to vary both a frequency and an amplitude of oscillation of said oscillating inner sleeve.

4. The ink roller of claim wherein said intermediate sleeve has a plurality of generally axially extending chambers on an outer circumferential surface, said chamber being in fluid communication with outer ends of said third bores.

5. The ink roller of claim 4 wherein adjacent ones of said chambers are separated by plateaus to provide said outer circumferential surface of said intermediate sleeve with a polygonal cross-sectional shape.

6. The ink roller of claim 1 wherein said means to rotate said intermediate sleeve includes a gear ring secured to a first end of said intermediate sleeve and a motor driven gear.

7. The ink roller of claim 1 wherein said means to rotate said outer sleeve includes a ring gear secured to an end face of said outer sleeve, said ring gear being in gear drive engagement with a driven gear of the printing press.

8. The ink roller of claim 1 wherein the number of said first bores and the number of said second bores is the same.

9. The ink roller of claim 1 wherein the number of said third bores is greater than the number of said second bores.

10. The ink roller of claim 1 wherein said first and second directions of rotation of said intermediate and outer sleeves are opposite.

11. The ink roller of claim 1 wherein said first and second directions of rotation of said intermediate and outer sleeves are the same.

12. The ink roller of claim 1 wherein said inner, intermediate, and outer sleeves are supported for rotation and oscillation with respect to each other by ball bearing assemblies carried in undercut ball bearing channels in said inner, intermediate and outer sleeves.

13. A method for metering an amount of ink supplied to an outer surface of an ink roller in a rotary printing press comprising the steps of:

providing a hollow axle having an ink reservoir and having a plurality of circumferentially arranged and radially extending first ink bores;

supplying printing ink under pressure to said ink reservoir and said first ink bores;

supporting an inner sleeve having a plurality of radially extending, circumferentially arranged second ink bores on said hollow axle;

oscillating said inner sleeve on said hollow axle and selectively aligning said first and second ink bores;

supporting an intermediate sleeve having a plurality of radially extending, circumferentially arranged third ink bores on said inner sleeve;

rotating said intermediate sleeve in a first direction and at a first speed to selectively align said second and third ink bores;

supporting an outer porous sleeve on said intermediate sleeve;

rotating said outer porous sleeve in a second direction and at a second speed; and selecting said first and second directions of rotation and said first and second speeds to provide said outer porous sleeve with a positive rotational differential with respect to said intermediate sleeve.

* * * * *